United States Patent [19]

Gröschl et al.

[11] 4,102,279

[45] Jul. 25, 1978

[54] FURNACE PLANT

[75] Inventors: Rupert Gröschl; Josef Gröschl; Ludwig Gröschl; Johann Gröschl, all of Wald, Schoberpass, Austria

[73] Assignees: Stefan Hahn, Styria; Norbert Drescher, Burgenland; Firma Johann Gröschl, Styra, all of Austria

[21] Appl. No.: 744,607

[22] Filed: Nov. 24, 1976

[30] Foreign Application Priority Data

Nov. 28, 1975 [AT] Austria ..... 9068/75
Jul. 8, 1976 [AT] Austria ..... 5023/76

[51] Int. Cl.[2] ..... F23G 5/00

[52] U.S. Cl. ..... 110/234; 110/293; 122/30; 110/254

[58] Field of Search ..... 110/18 C, 10, 29; 122/30, 212

[56] References Cited

U.S. PATENT DOCUMENTS

| | | | |
|---|---|---|---|
| Re. 23,319 | 1/1951 | Sanford et al. | 110/29 |
| 1,501,847 | 7/1924 | Howell | 110/29 |
| 2,010,460 | 8/1935 | McKinley | 110/18 |
| 2,504,528 | 4/1950 | Hume | 417/902 |
| 2,612,877 | 10/1952 | Cubitt | 122/30 |
| 3,217,193 | 11/1965 | Rayner | 62/505 |
| 3,233,822 | 2/1966 | Comstock et al. | 417/902 |
| 3,641,952 | 2/1972 | Wotschke | 110/18 |
| 3,777,676 | 12/1973 | Lagen | 110/11 |

*Primary Examiner*—Kenneth W. Sprague
*Attorney, Agent, or Firm*—Karl F. Ross

[57] ABSTRACT

A charging shaft in a furnace housing, communicating at its bottom with an adjoining combustion chamber, is topped by a sloping lid having an air-intake opening near its lower end, that opening registering with an underlying baffle defining with that lid a narrow rising channel for incoming air. Distillation gases evolving in the shaft, admixed with some of the entering air but prevented by that air from escaping through the channel, are recirculated through a port at the top of the shaft to an entrance near its bottom — just above a horizontal grate — by way of an adjacent duct provided with a lateral air inlet, the duct narrowing at that inlet into a constricted throat from which the recirculated gases are aspirated by the entering additional air. The connection between the charging shaft and the combustion chamber may be formed by an upright grill, or by a diverging passage accommodating an ancillary combustion device such as an oil burner. The channel and the duct are separated by a water-cooled partition.

19 Claims, 5 Drawing Figures

FURNACE PLANT

FIELD OF THE INVENTION

This invention relates to a furnace plant which comprises a charging shaft that is separated by a partition from an adjoining combustion chamber connected to the charging shaft by an exit port disposed above a grate. At least one duct disposed between the charging shaft and the housing of the furnace has a lower end which communicates through an entrance port with the charging shaft above the grate and also has an upper portion which communicates through another port with the charging shaft; the duct is supplied with air, preferably near its upper end, through an inlet opening which may be adjustable.

BACKGROUND OF THE INVENTION

In a plant of that kind it is known to provide a plurality of ports which maintain communication between the charging shaft and the air-intake duct so that air is supplied on various levels to the fuel contained in the charging shaft and the entire fuel charge is thus rendered glowing so that a single incandescent body is created in the charging shaft and may fill the same throughout its height. Under adverse conditions, particularly during the firing of household refuse which constitutes a low-grade fuel, the charging shaft could gradually become clogged in this way so that the operation of the plant may have to be discontinued.

OBJECT OF THE INVENTION

The object of our invention is to provide a furnace plant of the kind referred to in which this disadvantage is avoided.

SUMMARY OF THE INVENTION

Pursuant to our present invention the duct is separated from the charging shaft by a water-cooled wall which extends continuously between the upper and lower ports, air being constantly supplied to the upper portion of the charging shaft through a preferably adjustable intake opening so that a mixture of air and gases present in the charging shaft above the solid charge thereof enters the duct through the upper port thereof.

As a result of this feature of our invention, the gases produced by dry distillation can be withdrawn through the duct in admixture with air the resulting mixture can be circulated to a lower region above the grate and through the same to the part of the charging shaft containing the solid combustibles so that the distillation gases are burnt once more. In this way the invention enables satisfactory operation of the furnace plant also when fuels are fired which inherently give rise to problems, such as household refuse, waste leather, compressed waste straw, rubber of vehicle tires, and sawmill waste. In this case the incandescent zone does not spread all the way to the top of the charging shaft so that a gradual clogging of the furnace plant is reliably precluded. The combustion produces no or almost no smoke. The CO content of the flue gases is within the permissible range. If the partition between the duct and the charging shaft is water-cooled, this will promote the downward flow in the duct. Such circulation will also be promoted if, in accordance with a further feature of the invention, the gas-air mixture supplied to the duct through the upper port is subjected to an ejector action by letting the cross-section of the duct decrease in the direction of flow below the air-inlet opening communicating with the duct while covering this opening by a shield or damper which preferably protrudes freely into the duct from above and which divides the duct into two flow passages, one passage serving to conduct fresh air and the other serving to conduct the gas-air mixture which comes from the upper port.

Advantageously, in accordance with another feature of our invention designed to promote the downward current in the duct, the shield disposed in the upper portion of the duct overlies also the connecting port which leads to the charging shaft. This intensifies the aspiration of the dry distillation gases present in the charging shaft above the fuel.

To limit the amount of solids moving from the charging shaft to the bottom of the adjoining combustion chamber we prefer to construct the connection between the charging shaft and the combustion chamber as a substantially vertical grate formed, e.g., by rods or bars of fireclay or metal.

According to still another advantageous feature of our invention the intake opening formed in a lid above the charging shaft overlies a guide plate or baffle which slopes upwardly from the vicinity of the opening and has a free upper edge spaced from the opening. This arrangement will ensure the desired inflow of air into the charging shaft and will reliably prevent an escape of the gases produced by dry distillation because the latter cannot descend in the flow passage between the lid and the guide wall to the intake opening contrary to the flow of incoming air.

The field of application of the plant according to the invention will be extended if, in accordance with a further feature of the invention, a burner for firing liquid fuel, e.g. oil, opens into the connecting port between the charging shaft and the adjoining combustion chamber. In that case the furnace plant can also be operated as an oil-fired furnace and need not be used to burn only solid fuel or solid refuse. When the plant according to the invention is used to burn low-grade fuel or refuse, the burner can be operated in addition to promote the combustion as an afterburner (reheater). Alternatively, the burner may be used to start the plant, particularly where difficultly ignitable materials are used.

BRIEF DESCRIPTION OF THE DRAWING

The above and other features matter of the invention will now be explained more fully with reference to the accompanying drawing, in which.

SPECIFIC DESCRIPTION

Figure 4:
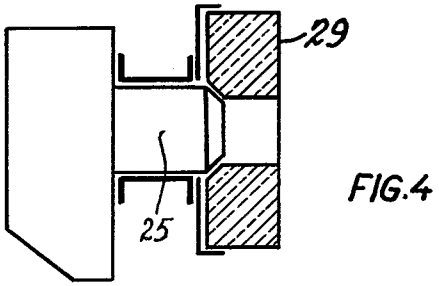
FIG. 4 is a fragmentary sectional view taken on line IV—IV in FIG. 3.

In the furnace plant according to the invention shown in the drawing, a charging shaft 1 is separated by a wall or partition 13 from a combustion chamber 2 adjoining the charging shaft in the direction in which the flue gases are exhausted. The furnace plant is charged through a sloping lid or door 14, which is disposed on the top of the plant and is provided nearer its lower end with an adjustable intake opening 3 through which air can be supplied to the upper portion of the charging shaft 1. The opening 3 registers with an underlying baffle or guide plate 22, which rises parallel to the lid and has a free upper edge spaced from the opening. This guide plate 22 constitutes a barrier which effectively prevents an escape of gases produced by dry distillation from the charging shaft 1 through the opening 3 inasmuch as the air entering the charging shaft 1 flows around the free upper plate edge whereas the lower edge of the guide plate is connected to the lid 14 just below opening 3. This arrangement ensures that the air admitted through the opening 3 rises in a narrow channel between the guide plate and the lid and prevents an opposite flow of distillation gases to the opening 3 through that channel.

The combustion chamber 2 communicates with the charging shaft through a connecting port 7 disposed above a horizontal grate 6. The port 7 is constituted by a substantially grill or grate 11 which is shown more in detail in FIG. 2 and is seen to consist of lower and upper bars 15, 15' of fireclay or metal, for example. The lower bars 15 rise from the level of grate 6 and are separated by a horizontal slot from the upper bars 15' which depend from the partition 13.

Figure 3:
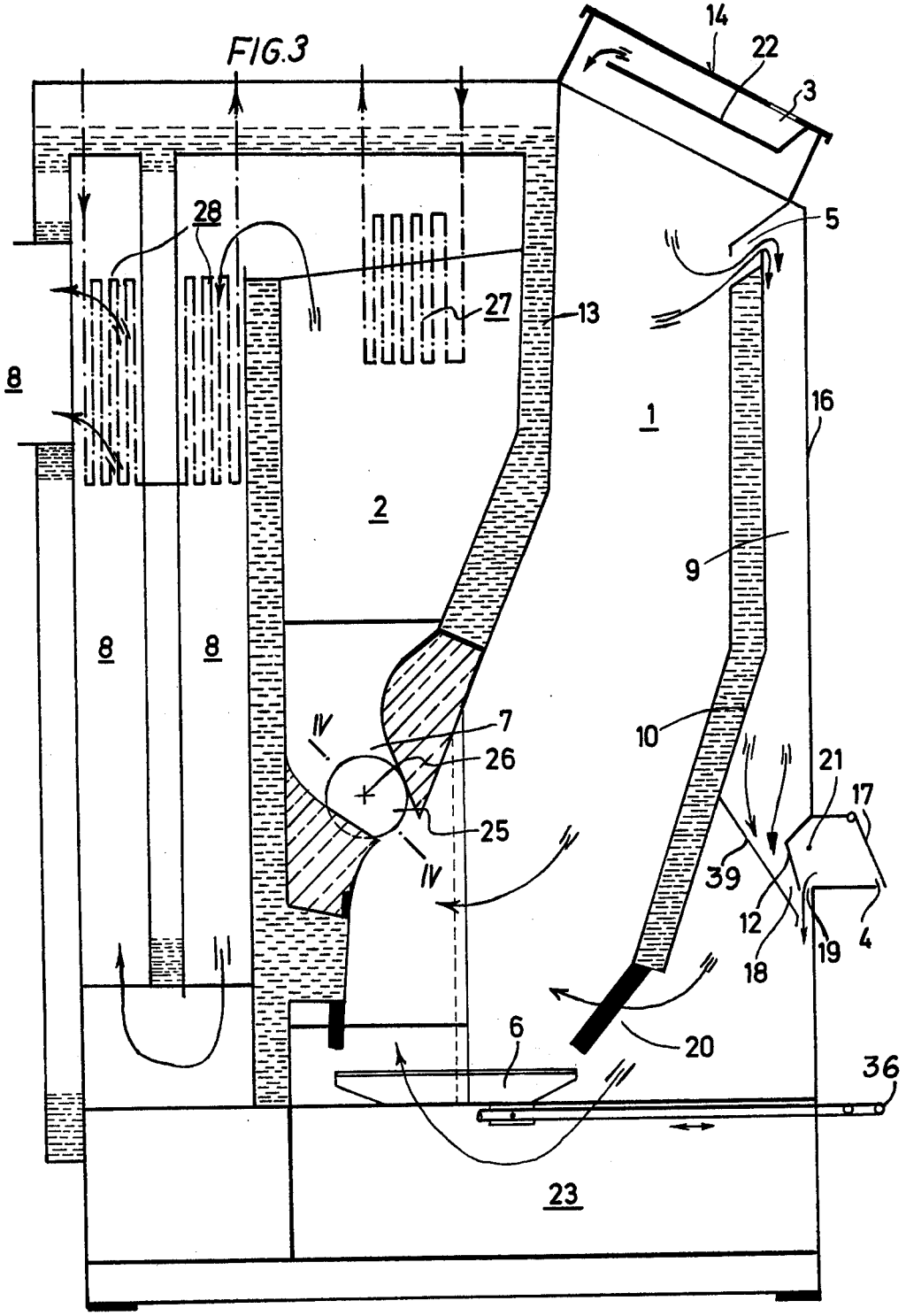
FIG. 3 a longitudinal sectional view showing the second embodiment.

In the embodiment shown in FIGS. 3 and 4, a burner 25 for firing liquid fuel, e.g. oil, opens into the port 7. The axis 26 of the burner 25 lies in a plane which is substantially parallel to the grate 6, i.e. horizontal connecting port 7 diverges here toward combustion chamber 2.

Figure 2:
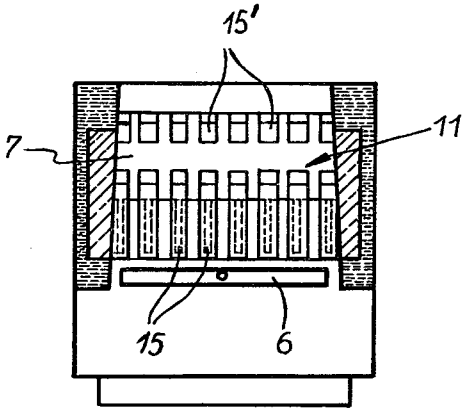
FIG. 2 is a fragmentary sectional view taken on line II—II in FIG. 1.
Figure 1:
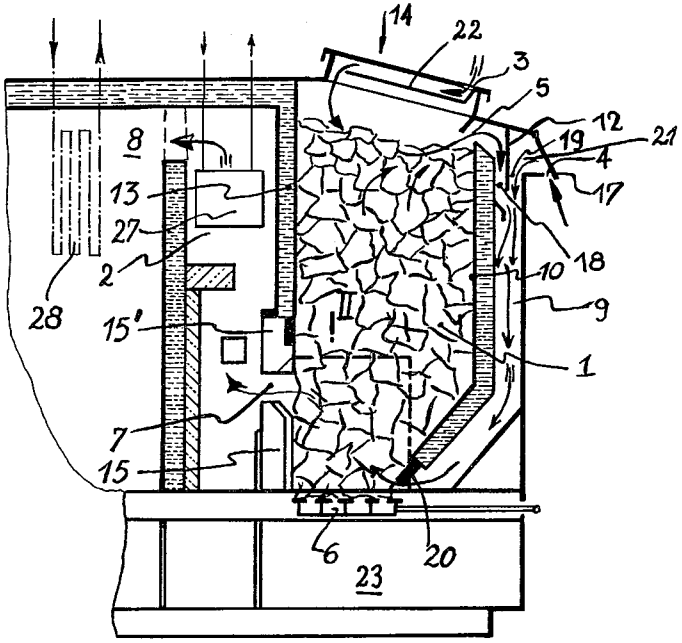
FIG. 1 is a longitudinal sectional view showing a first embodiment of a furnace plant according to the invention.

An upright duct 9 is provided between the charging shaft 1 and the furnace housing and, in the embodiments shown by way of example, is disposed on the forward side of the furnace plant. Alternatively, or in addition, such a duct may be provided behind one or both side walls of the furnace plant. The lower end of the duct 9 communicates with the charging shaft 1 above the grate 6 via an entrance port 20. The upper portion of the duct 9 communicates also with the charging shaft 1 through a recirculation port 5 through which the duct 9 is supplied with a mixture consisting of fresh air, which has entered the charging shaft through opening 3, and gases which have been produced by dry distillation and are present in the charging shaft above the body of solids contained therein. Additional air can be supplied to the duct 9 through an inlet 4, which in the embodiment shown in FIGS. 1 and 2 is disposed near the upper end of the charging shaft remote from the grate 6 and in the embodiment shown in FIG. 3 is adjacent the lower end of the charging shaft proximal to the grate 6. In both embodiments, the air is admitted through a lateral wall opening 21 in the housing of the furnace. The inlet 4 can be controlled by a flap 17. The gas-air mixture coming from the duct 9 may be circulated to the charging shaft 1 from below through an ash chamber 23 and through the grate 6. The lateral opening 21 is overhung by a shield or deflector 12 which divides the duct 9 into two flow passages 18, 19. The flow passage 18 is nearer to the charging shaft 1 than the flow passage 19 and is traversed by the aforementioned mixture of air and gaseous product of incomplete combustion. Pure air enters the duct 9 through the flow passage 19.

To produce an ejector action for improving the removal from the charging shaft 1 of the gases present above the body of solids, the duct 9 is constricted adjacent the free edge of deflector 12 between the latter and a shelf 39 extending from the wall 10 which separates the duct 9 from the charging shaft. The fresh air entering through the flow passage 19 is caused by the constricted throat to exert suction on the gases present in the charging shaft 1 and the port 5. In the embodiment shown in FIG. 3, and the air inlet 4 could also be disposed near the upper end of the duct 9 substantially at the level of port 5, as in FIG. 1, with interposition of deflector 12 between the opening 21 and the port 50.

The boundary walls of the charging shaft 1 may be filled with water, as indicated in the drawing, to promote the downward flow of the gaseous mixture in the duct 9 by cooling same.

As is shown in dash-dot lines, the combustion chamber 2 may contain heat-exchange surfaces 27, e.g., of pipe coils, for heating water used in a central heating system. Heat exchangers 28 may also be installed in an adjoining flue 8, as likewise indicated by dash-dot lines.

Figure 5:
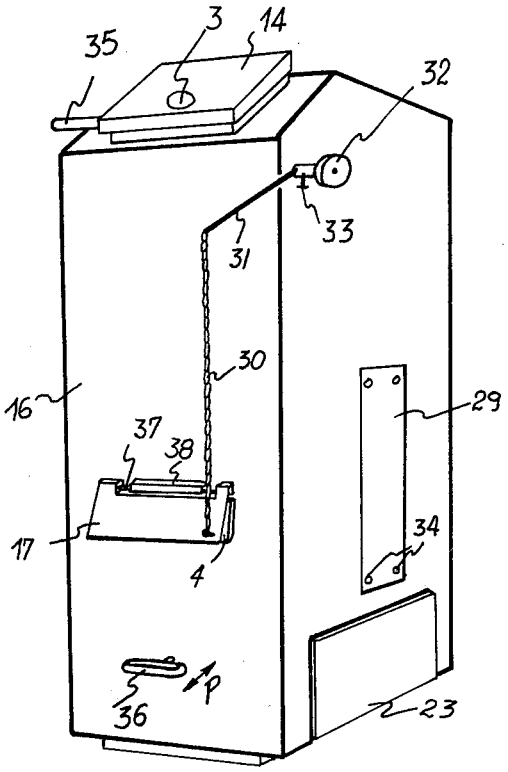
FIG. 5 is a schematic perspective view of the furnace plant shown in FIG. 3.

It is apparent from FIG. 5 that the flap 17 can be locked in various positions by means of a chain 30, which is secured to an arm 31, so that the cross-section of the inlet opening 4 can be changed. The arm 31 is vertically swingable by means of a handle 32 which is pivoted on a pin secured to a side wall of the furnace housing and which can be fixed in any desired position by a screw 33. The hinge pin for the flap 17 is designated 37 and is received by an abutment 38 provided on the front wall 16 of the furnace housing. A handle 35 is provided for the operation of the lid 14 formed with the air-intake opening 3. By means of a handle 36, the grate 6 can be moved in the direction of the arrow P shown in FIG. 5 to produce a shaking motion, which causes ash disposed above the grate 6 to fall into the slidable ashbox 23, adapted to laterally extracted from the furnace plant. The side wall carrying the handle 33 is also formed with an opening which can be closed by a cover plate 29 and in which the burner 25 can be mounted (FIG. 4). The plate 29 is to the housing by means of screws 34.

What is claimed is:

1. A furnace comprising:

a housing forming a charging shaft and an adjoining combustion chamber communicating with each other through a connection near the bottom of said shaft;

a grate below said connection underneath said shaft;

partition means in said housing separating said shaft from an upright duct communicating with said shaft through an upper port and a lower port adjacent said grate;

intake means above said shaft supplying same with fresh air for sustaining a combustion of a solid charge in said shaft, part of said fresh air mingling with gaseous products of incomplete combustion to form a mixture recirculated via said upper port, said duct and said lower port to said shaft for further burning; and baffle means above said shaft for preventing the escape of said gaseous products via said intake means.

2. A furnace as defined in claim 1 wherein said intake means comprises a sloping lid provided with an opening near a lower end thereof, said baffle means comprising a guide plate joined to said lid at said lower end and rising past said opening substantially parallel to said lid, said plate terminating in a free edge offset from said opening and defining with said lid a narrow rising channel for incoming air.

3. A furnace as defined in claim 1 wherein said connection comprises an upright grill.

4. A furnace as defined in claim 1 wherein said connection comprises a passage diverging toward said combustion chamber.

5. A furnace as defined in claim 4, further comprising ancillary combustion means disposed in said passage.

6. A furnace as defined in claim 5 wherein said ancillary combustion means comprises an oil burner centered on a horizontal axis.

7. A furnace as defined in claim 1 wherein said partition means is water-cooled.

8. A furnace as defined in claim 1, further comprising lateral inlet means for additional air in a wall of said housing forming an outer boundary of said duct.

9. A furnace as defined in claim 8 wherein said duct is provided with deflector means forming a constricted throat and a passage adjacent said throat communicating with said lateral inlet means for admitting said additional air with resulting aspiration of said recirculated mixture.

10. A furnace as defined in claim 9 wherein said lateral inlet means forms a wall opening overhung by said deflector means.

11. A furnace as defined in claim 10 wherein said lateral inlet means is disposed at the top of said duct, said deflector means being interposed between said upper port and said wall opening.

12. A furnace as defined in claim 9 wherein said lateral inlet means is disposed near the bottom of said duct above the level of said lower port.

13. A furnace as defined in claim 9, further comprising adjustable flap means overlying said wall opening from the outside.

14. A furnace comprising:

a housing forming a charging shaft and an adjoining combustion chamber communicating with each other through a connection near the bottom of said shaft;

a grate below said connection underneath said shaft;

partition means in said housing separating said shaft from an upright duct communicating with said shaft through an upper port and a lower port adjacent said grate;

intake means for supplying the top of said shaft with fresh air for maintaining a combustion of a solid charge in said shaft, part of said fresh air mingling with gaseous products of incomplete combustion to form a mixture recirculated via said upper port, said duct and said lower port to said shaft for further burning;

deflector means in said duct forming a constricted throat; and lateral inlet means for additional air in a wall of said housing forming an outer boundary of said duct, said lateral inlet means opening into said duct just below said throat for admitting said additional air with resulting aspiration of said recirculated mixture.

15. A furnace as defined in claim 14 wherein said lateral inlet means forms a wall opening overhung by said deflector means.

16. A furnace as defined in claim 15 wherein said lateral inlet means is disposed at the top of said duct, said deflector means being interposed between said upper port and said wall opening.

17. A furnace as defined in claim 14 wherein said lateral inlet means is disposed near the bottom of said duct above the level of said lower port.

18. A furnace as defined in claim 14, further comprising adjustable flap means overlying said wall opening from the outside.

19. A furnace as defined in claim 14 wherein said partition means is water-cooled.

* * * * *